US009400143B2

(12) United States Patent
Grande Fernández et al.

(10) Patent No.: US 9,400,143 B2
(45) Date of Patent: Jul. 26, 2016

(54) DEVICE FOR REDUCING THE VIBRATIONS OF A TUBE BUNDLE OF A HEAT EXCHANGER INSIDE ITS SHELL

(75) Inventors: José Antonio Grande Fernández, Vigo-Pontevedra (ES); Ángel Chamadoira Gómez, Vigo-Pontevedra (ES)

(73) Assignee: BORGWARNER EMISSIONS SYSTEMS SPAIN, S.L. UNIPERSONAL, Vigo-Pontevedra (ES)

( * ) Notice: Subject to any disclaimer, the term of this patent is extended or adjusted under 35 U.S.C. 154(b) by 253 days.

(21) Appl. No.: 14/113,123

(22) PCT Filed: May 10, 2012

(86) PCT No.: PCT/EP2012/058618

§ 371 (c)(1),
(2), (4) Date: Oct. 21, 2013

(87) PCT Pub. No.: WO2012/152860

PCT Pub. Date: Nov. 15, 2012

(65) Prior Publication Data

US 2014/0041832 A1 Feb. 13, 2014

(30) Foreign Application Priority Data

May 11, 2011 (EP) ..... 11382143

(51) Int. Cl.
*F28F 7/00* (2006.01)
*F28F 9/013* (2006.01)
*F28D 7/16* (2006.01)

(52) U.S. Cl.
CPC ..... *F28F 9/0133* (2013.01); *F28D 7/16* (2013.01); *F28D 7/1684* (2013.01); *F28F 9/013* (2013.01); *F28F 2265/30* (2013.01)

(58) Field of Classification Search
CPC ..... F28F 9/0133; F28F 9/06; F28F 9/08; F28F 9/013; F28F 9/0132; F28F 2265/28; F28F 2265/30; F28D 7/16; F28D 7/0025; F28D 7/1684; F28D 7/06
USPC ..... 165/69, 162
See application file for complete search history.

(56) References Cited

U.S. PATENT DOCUMENTS 3,222,448 A * 12/1965 Rogers ..... H05K 7/12 165/133
4,356,795 A * 11/1982 Loiez ..... F28F 9/013 122/510

(Continued)

FOREIGN PATENT DOCUMENTS

CN 1160183 9/1997
CN 101061363 10/2007

(Continued)

OTHER PUBLICATIONS

Extended European Search Report dated Sep. 9, 2011 in corresponding European Patent Application No. 11382143.3.
Chinese Search Report corresponding to Application No. 201280022353.0 dated Apr. 8, 2015.
International Preliminary Report on Patentability corresponding to International Application No. PCT/EP2012/058618 dated Nov. 12, 2013.

(Continued)

*Primary Examiner* — Marc Norman
*Assistant Examiner* — Jon T Schermerhorn
(74) *Attorney, Agent, or Firm* — Jenkins, Wilson, Taylor & Hunt, P.A.

(57) ABSTRACT

The present invention relates to a device for reducing the vibrations of a tube bundle of a heat exchanger inside its shell, wherein this device allows a secure and quick insertion after the bundle has been manufactured. This easy insertion after manufacturing the bundle allows the high temperatures to which the bundle is subjected for the attachment by means of brazing to not affect the properties of the device, particularly the elasticity achieved by means of tempering, for example.

16 Claims, 4 Drawing Sheets

(56) References Cited

U.S. PATENT DOCUMENTS

| | | | | |
|---|---|---|---|---|
| 4,733,722 | A | 3/1988 | Forbes et al. | |
| 6,920,918 | B2 * | 7/2005 | Knecht | F28D 7/1684 165/157 |
| 8,720,534 | B2 * | 5/2014 | Barwig | F02B 29/0462 165/145 |
| 8,978,740 | B2 * | 3/2015 | Schatz | F28D 7/1684 165/162 |
| 2008/0006398 | A1 | 1/2008 | Schatz et al. | |
| 2008/0236792 | A1 * | 10/2008 | Mast | B23P 15/26 165/157 |
| 2009/0277606 | A1 * | 11/2009 | Reiss, III | F28D 7/1692 165/69 |
| 2010/0276131 | A1 * | 11/2010 | Barwig | F02B 29/0462 165/162 |
| 2011/0067837 | A1 * | 3/2011 | Schatz | F28D 7/1684 165/69 |
| 2013/0192803 | A1 * | 8/2013 | Garret | F28D 7/1684 165/151 |

FOREIGN PATENT DOCUMENTS

| | | | |
|---|---|---|---|
| CN | 101093153 | | 12/2007 |
| CN | 101349525 | | 1/2009 |
| CN | 101755186 | | 6/2010 |
| DE | 10 2008 046690 | A1 | 3/2009 |
| EP | 1870656 | A2 | 12/2007 |
| JP | 54-182461 | | 12/1979 |
| JP | 59-144384 | | 9/1984 |
| JP | 2005-156140 | | 6/2005 |

OTHER PUBLICATIONS

International Search Report corresponding to International Application No. PCT/EP2012/058618 dated Dec. 10, 2012.

Office Action corresponding to Japanese Patent Application No. 2014-509732 mailed Sep. 8, 2015.

* cited by examiner

DEVICE FOR REDUCING THE VIBRATIONS OF A TUBE BUNDLE OF A HEAT EXCHANGER INSIDE ITS SHELL

CROSS-REFERENCE TO RELATED APPLICATIONS

This application is filed under the provisions of 35 U.S.C. §371 and claims the priority of International Patent Application No. PCT/EP2012/058618 filed on May 10, 2012, and of European Patent Application No. 11382143.3 filed on May 11, 2011. The disclosures of the foregoing international patent application and European patent application are hereby incorporated by reference herein in their respective entireties.

OBJECT OF THE INVENTION

The present invention relates to a device for reducing the vibrations of a tube bundle of a heat exchanger inside its shell, wherein this device allows a secure and quick insertion after the bundle has been manufactured. This easy insertion after manufacturing the bundle allows the high temperatures to which the bundle is subjected for the attachment by means of brazing to not affect the properties of the device, particularly the elasticity achieved by means of tempering, for example.

BACKGROUND OF THE INVENTION

The heat exchangers designed for high fluid flow rates, for example those used in "EGR" (Exhaust Gas Recirculation) systems for reducing nitrogen oxide ($NO_x$ emissions in internal combustion engines, are devices with important masses.

The usual configuration is that of arranging a shell housing a tube bundle, which tubes form a packing. Inside the shell there circulates a first fluid, the liquid coolant, which removes heat from the tube bundle, through which tubes there circulates a second fluid, the gas to be cooled.

The tube bundle has a longitudinal shape and its mass is important. When this exchanger is subjected to external excitations as occurs in a vehicle, the bundle has a dynamic behavior which is characterized by the fundamental modes of vibration. The most relevant is the first fundamental mode of vibration and is associated with the lowest fundamental frequency. The shifts due to deformation in the antinodes of the wave associated with the mode of vibration can be high, giving rise to significant deformations which are the cause of fatigue of materials, mechanical interferences and therefore the source of breakages and noise.

In particular, truck exchangers are very long, being able to reach lengths of over 300 mm with bundles having natural frequencies of around 200 Hz, which are within the range of the engine. This type of bundles or also referred to as batteries can weigh between 5 and 11 kilograms, giving rise to very resistant supports.

The usual way of manufacturing these bundles is by means of brazing. The pipes, attachment parts and supports are assembled by interposing in the attachment surfaces brazing paste containing alloys which melt below the melting point of the component parts. The assembly thus attached is introduced in a furnace causing the melting of the brazing paste but not that of the metal of the parts to be attached. Nevertheless, although these parts do not reach a melting temperature, the temperatures of the furnace can be around 1100° C., which is sufficient to soften them. For example, a steel with martensitic structures obtained by means of tempering to achieve certain elastic properties would disappear after passing through the brazing furnace.

The bundle is formed by pipes, the natural frequency of which depends on the length thereof, the latter being reduced as said pipes are made longer. When the natural frequency of the pipes is very low and is close to the first harmonics caused by the engine, the bundle can enter into resonance and a breakage due to vibrations can occur. To prevent the problems of vibrations of the bundle of the exchanger inside the shell, support points between the bundle and the shell different from the ends are established, such that the pipes forming the bundle work as if they were shorter than they actually are, and therefore they have a higher natural frequency, far from the frequencies at which the engine vibrates. These intermediate support points therefore define new nodes which change the dynamic behavior of the bundle due to vibration.

It is convenient for these support points between the bundle and the shell to be elastic, therefore if elastic parts are incorporated for this purpose they must be installed after passing through the furnace because otherwise their elastic properties would be destroyed and any deformation that they experience would be permanent.

The solution proposed in the European patent with publication number EP1870656A2 is known. This patent application describes elastic clips which can be installed after the bundle has passed through the furnace.

The clips described are installed in one of the faces of the tube bundle, either because an anchor receiving the elastic element has previously been fixed on the bundle (in the furnace for example), or the part which keeps the tubes attached at certain points of the length of the bundle is used. This part is usually referred to as baffle.

When this part is used, holes are made which admit a flat bar from which a wedge- or harpoon-shaped element emerges. This configuration allows the insertion by sliding the elastic support in a direction parallel to the main longitudinal direction of the bundle and transverse to the part. To be removed, it is necessary to press the flexible wedge- or harpoon-shaped section and force the exit.

All the proposed solutions require the insertion in each of the faces of the bundle in an independent manner and although the anchor prevents the exit thereof it does not assure an attachment without vibrations. The wedge or harpoon recovers its position after the insertion if it has a certain clearance. This clearance is maintained after the insertion and can give rise to unwanted vibrations.

The present invention proposes a simpler alternative solution which allows its installation once the bundle has already passed through the furnace, drastically reduces the installation time and also allows its removal for its replacement in a quick manner.

DESCRIPTION OF THE INVENTION

The present invention relates to a device which can be installed in a heat exchanger, preferably in an exchanger belonging to an EGR system for cooling the exhaust gases of a internal combustion engine, which is arranged in the tube bundle or battery, which tubes are housed in the shell such that an elastic support of the bundle is established on the inner surface of the shell. The special configuration of this device allows solving the problems described above.

The bundle for which this device is intended has a configuration comprising at least one main face and two adjacent side faces and wherein the bundle furthermore has one or more linking parts or "baffles" between tubes, giving rise to a protrusion in the main face and the adjacent side faces.

The tubes configuring the bundle are held by means of a part which is referred to as a linking part or "baffle". This part maintains a constant attachment between the different tubes if they are subjected to vibration. This part is required to protrude from the packing formed by the assembly of tubes of the bundle both in the main surface and in the adjacent side surfaces. The anchoring of the device will be established in this protruding area.

As has been described in the state of the art, clips are known which are likewise fixed to the linking part but require the presence of holes in which a wedged tab that allows the entrance but not the exit is inserted.

The device of the present invention additionally comprises:

a first section adapted to be arranged on the main face and two second sections adapted to be arranged on the side faces, wherein these second sections emerge from the ends of the first section and are arranged in opposition, such that the first section and the second sections configure a "U". This first feature of the device defines a mode of linking with the bundle based on the shape that it has. The presence of two arms extending over both side faces will allow the retention when it is installed, the easy insertion during the installation and its extraction when its replacement is necessary.

one or more anchors arranged in each section configured in a "U" shape and oriented towards the inside of the "U" formed by the first section and the second sections, these anchors being adapted to receive the protrusion formed by the linking parts between tubes of the bundle.

The linking part protrudes in the main face and also in the side faces. The device has a "U" shape with a first section intended to be supported on the main face and two second sections intended to be supported in the side faces. Each of these sections in turn has anchors which also have a "U" shape. These anchors cover a portion of the protrusion formed by the linking part.

The insertion of the device towards the bundle makes the anchors achieve said anchoring by making an approach in a different manner. The anchors which are in the first section approach the protrusion formed by the linking part in an opposite manner and move closer until the U-shaped anchor covers a section of the protrusion. The approaching movement is transverse to the protrusion in the main face. On the other hand, the anchors which are in the second section, with the same approaching movement, move parallel to the protrusion of the side faces. They first make contact with the start of the protrusion on the side face housing the protrusion inside the "U" of the anchor; and, until reaching the final position, they slide allowing the protrusion to slide along their interior.

With this configuration of the device it is possible to incorporate supports on the three faces, the main face and the two adjacent side faces, in a single insertion operation.

These anchors, thus configured, allow the insertion and extraction of the device towards and from the bundle and, in turn, the "U" shape limits the movement of the device in the longitudinal direction defined by the tubes of the bundle.

one or more elastic support elements arranged in each section and oriented towards the outside of the "U" formed by the first section and the second sections, these elastic support elements being adapted to be supported on the inside of the casing of the heat exchanger.

Once the device is located in the final position, it solves the problem of establishing the support between the bundle and the casing by arranging elastic support elements on the outside of the "U".

In the preferred embodiment of the invention, this elastic element is configured by die-cutting and subsequently bending the flat bar which gives rise to all the elements of the device. The elastic properties of the material used are not affected by the high temperatures of the brazing furnace since the device is installed after the bundle is manufactured.

The support between the bundle and the casing define new nodes in the modes of vibration of the bundle, raising the values of the frequency associated with the modes of vibration with lower characteristic frequencies.

both second sections comprise a retaining clip such that both clips operate in opposition to retain the device in the bundle.

Once the device is inserted on the bundle, the presence of a retaining clip on each side retains the device elastically. The first section and the second sections configured in a "U" shape have an elastic behavior. The presence of a clip in each second side section and operating in opposition traps the bundle. In the preferred mode of the invention the clips have the form of a protrusion towards the inside of the main "U" formed by the first section and the second sections. The protrusion towards the inside enters a groove, for example the one formed by two adjacent tubes. It would likewise be possible to arrange the second sections with a greater length and allow the support of the clips in the edge where the side surface ends.

The present invention can be carried out according to the various embodiments, particularly those established by means of dependent claims 2 to 8, which are incorporated by reference to this description.

A heat exchanger incorporating at least one device according to claim 9, wherein this exchanger according to claim 9 is incorporated by reference to this description, is also an object of this invention.

DESCRIPTION OF THE DRAWINGS

These and other features and advantages of the invention will be more clearly shown from the following detailed description of a preferred embodiment, given only by way of an illustrative and non-limiting example, with reference to the attached figures.

DETAILED DESCRIPTION OF THE INVENTION

Figure 1:
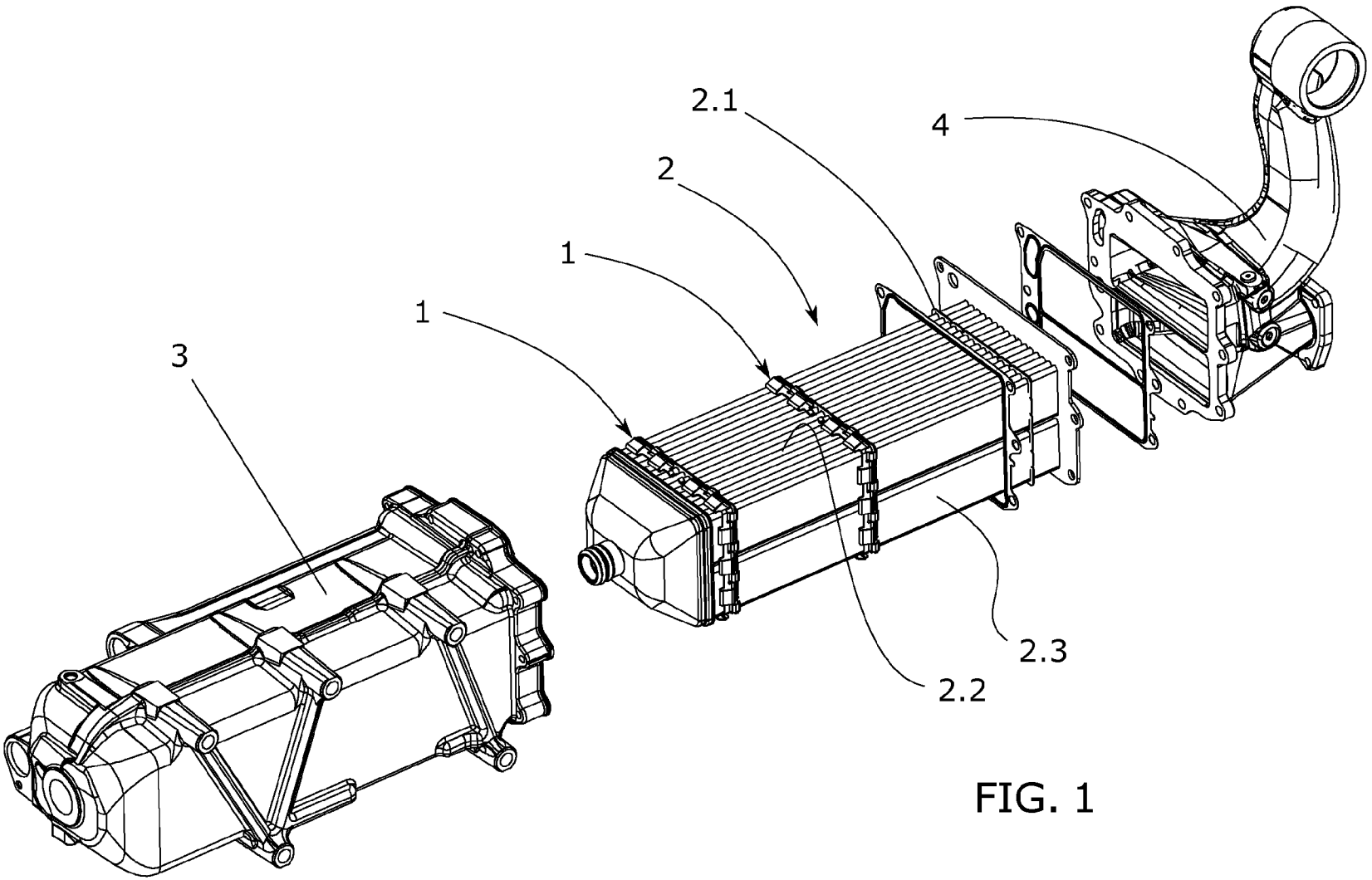
FIG. 1 shows an embodiment of a heat exchanger for an EGR system for the recirculation of gases in an internal combustion engine. This heat exchanger is shown according to an exploded perspective view and allows observing the position of two devices for reducing the vibrations according to a way of carrying out the invention.

FIG. 1 shows an embodiment of a heat exchanger formed by a shell (3) housing a tube bundle (2), also referred to as battery, therein. The shell (3) has inlets and an outlet for a liquid coolant (not indicated for the sake of clarity of the drawing) circulating therein.

This liquid coolant is in contact with the tube bundle (2), through which tubes the gas to be cooled circulates. The hot gas transfers the heat to the liquid coolant through the exchange surface which defines the tubes forming the tube bundle (2).

This tube bundle (2) also has in turn an inlet and a differentiated outlet for the second fluid, the gas to be cooled. The figure shows the gas outlet manifold (4).

The tube bundle (2) is housed inside the shell (3) such that there is a space between the bundle and the inner surface of the shell (3). The bundle (2) is subjected to vibrations and is deformed along its length depending on the securing at its ends.

This same figure shows a linking part (2.1) keeping the tubes forming the tube bundle (2) secured to one another, at a certain distance. In the example shown in FIG. 1 there are three linking parts (2.1), two covered with a device (1) according to an embodiment of the invention and a third (2.1) which is uncovered in order to allow showing the arrangement and configuration thereof.

This linking part (2.1) is shown protruding in the four walls defining the tube bundle (2) with a prismatic shape. Although the support of the device (1) according to this embodiment occurs directly with the surface of the tube bundle (2), the linking part (2.1) allows the retention in the longitudinal direction. The longitudinal direction is considered to be the preferred direction established by the tubes of the bundle (2).

The devices (1) for reducing the vibrations according to a first embodiment are supported in three faces of the prismatic body of the tube bundle (2), a face which will be referred to as the main face (2.2) and two faces which will be referred to as side faces (2.3). These faces (2.2, 2.3) can have recesses or notches in the spaces between tubes, for example. Once the devices (1) are arranged on the tube bundle (2), they offer towards the outside elastic support elements (1.3) intended to be supported in the inner face of the shell (3) when the bundle is introduced inside the shell (3). This support establishes a node for the mode of vibration of the bundle (2) in the longitudinal position of the device (1).

Once installed, the device (1) must allow an easy insertion in the shell (3) and must be securely linked to the bundle (2) to allow the insertion without the device (1) moving longitudinally with respect to the bundle (2).

Secondarily, it is convenient for it to also allow the exit of the bundle (2) to allow maintenance tasks.

Figure 2B:
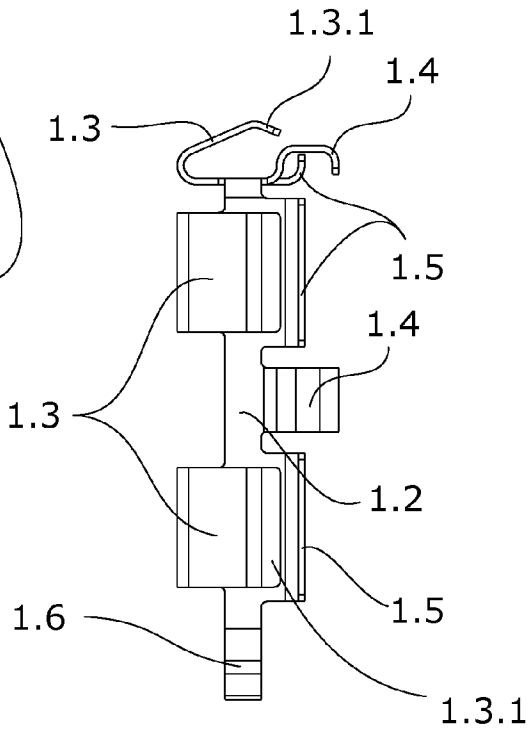
FIGS. 2*a*, 2*b* show the device according to an embodiment according to an elevational and profile view.
Figure 2A:
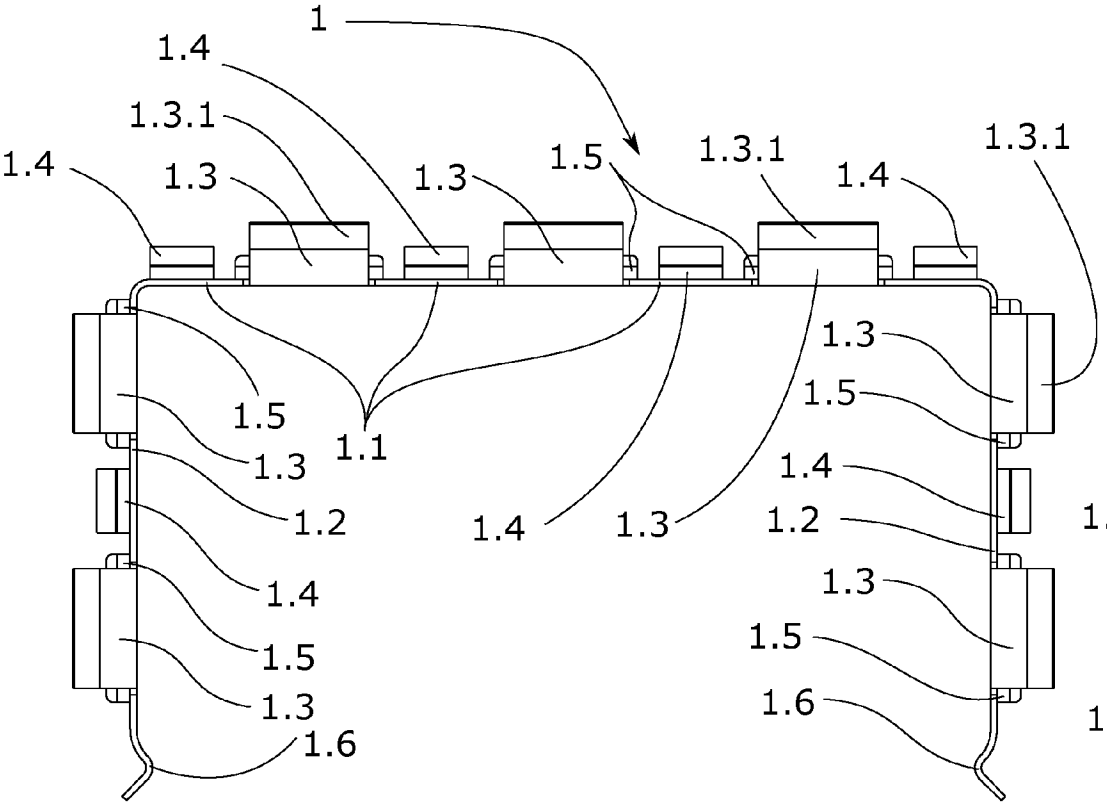
Figure 3:
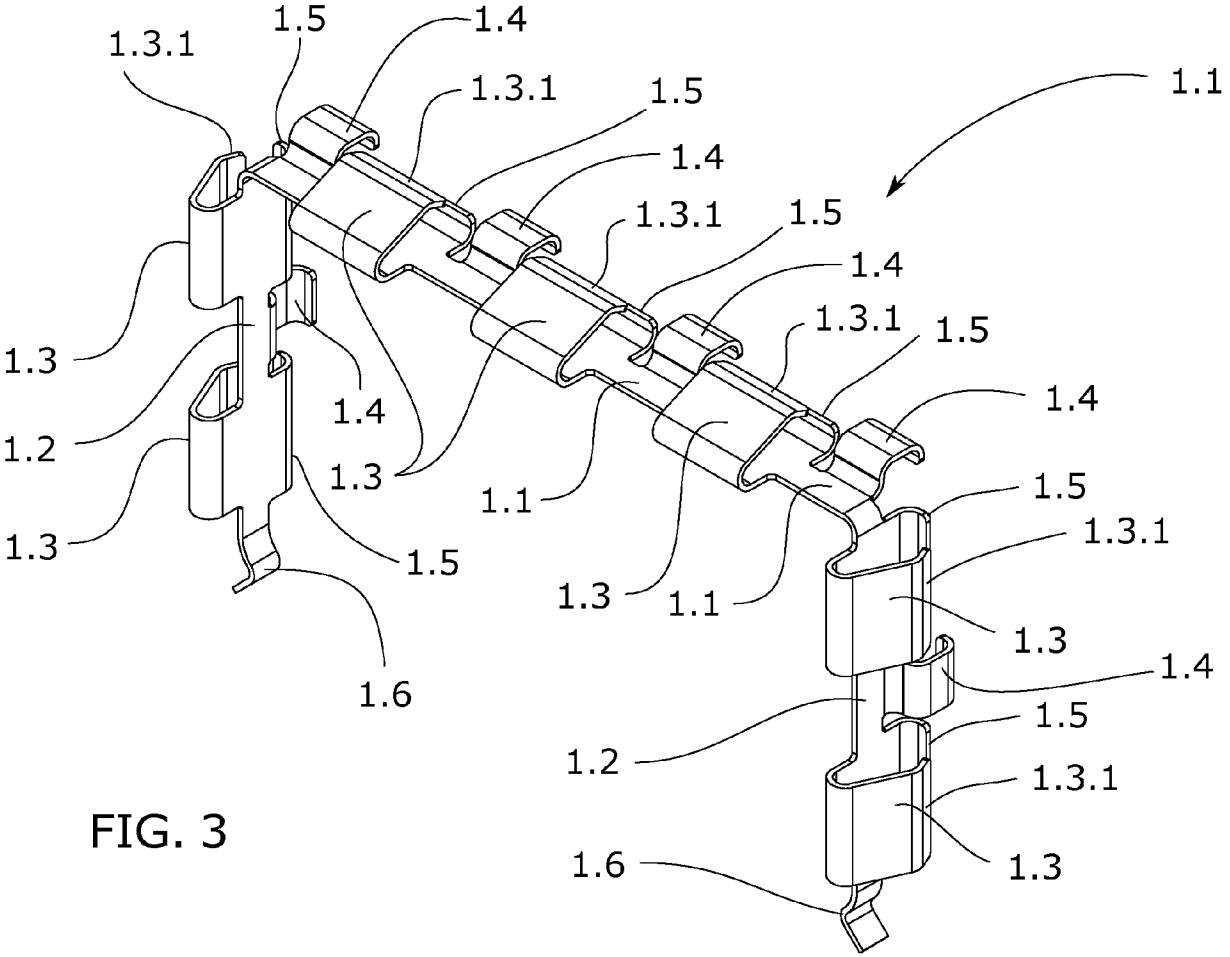
FIG. 3 shows the same embodiment of the device in a perspective view.

Considering FIGS. 2*a*, 2*b* and 3, it is observed that the configuration of the device (1) according to the present invention has been obtained by means of a die-cut and subsequently bent flat bar.

This flat bar shows a first section (1.1) which is extended by means of two second sections (1.2). Once bent, these second sections (1.2) configure a "U" with the second sections (1.2) in opposition. This U-shaped configuration allows embracing the main face (2.2) and the two side faces (2.3) of the bundle (2).

From the flat bars forming the first section (1.1) and from the second sections (1.2), there extend laterally bent flat bars forming towards one side flexible elements (1.3) and towards the other side there extend laterally bent flat bars forming anchors (1.4) and also skids (1.5).

The flexible elements (1.3) are flexible strips due to their greater length and the nature of the material used which is flexible. These flexible elements (1.3) allow the support of the device (1) in the inner face of the shell (3). The support of the flexible elements (1.3) in the inner face of the shell (3) preferably occurs in a place which is projected (according to the direction perpendicular to the support surface of the device (1) on the tube bundle (2)) wherein the support surface rests on the tube bundle (2).

The flexible elements (1.3) have a height with respect to the first or second sections (1.1, 1.2) from which they emerge greater than the distance between the bundle (2) and the inner wall the shell (3) in order to thus be able to maintain an elastic force of distancing between both elements. The wedged shape of the flexible elements (1.3) allows the easy entrance of the bundle (2) inside the shell (3) even despite the fact that this greater height means a mechanical interference.

The ends of the flexible elements (1.3) are in turn bent towards the inside in order to also offer a wedged surface in the direction of the exit of the bundle with respect to the shell (3).

The shape of the anchors (1.4) is a "U" shape, wherein this "U" shape is oriented such that it covers, at the upper part, the protrusion formed by the linking part (2.1) of the tubes of the bundle (2).

Figure 4:
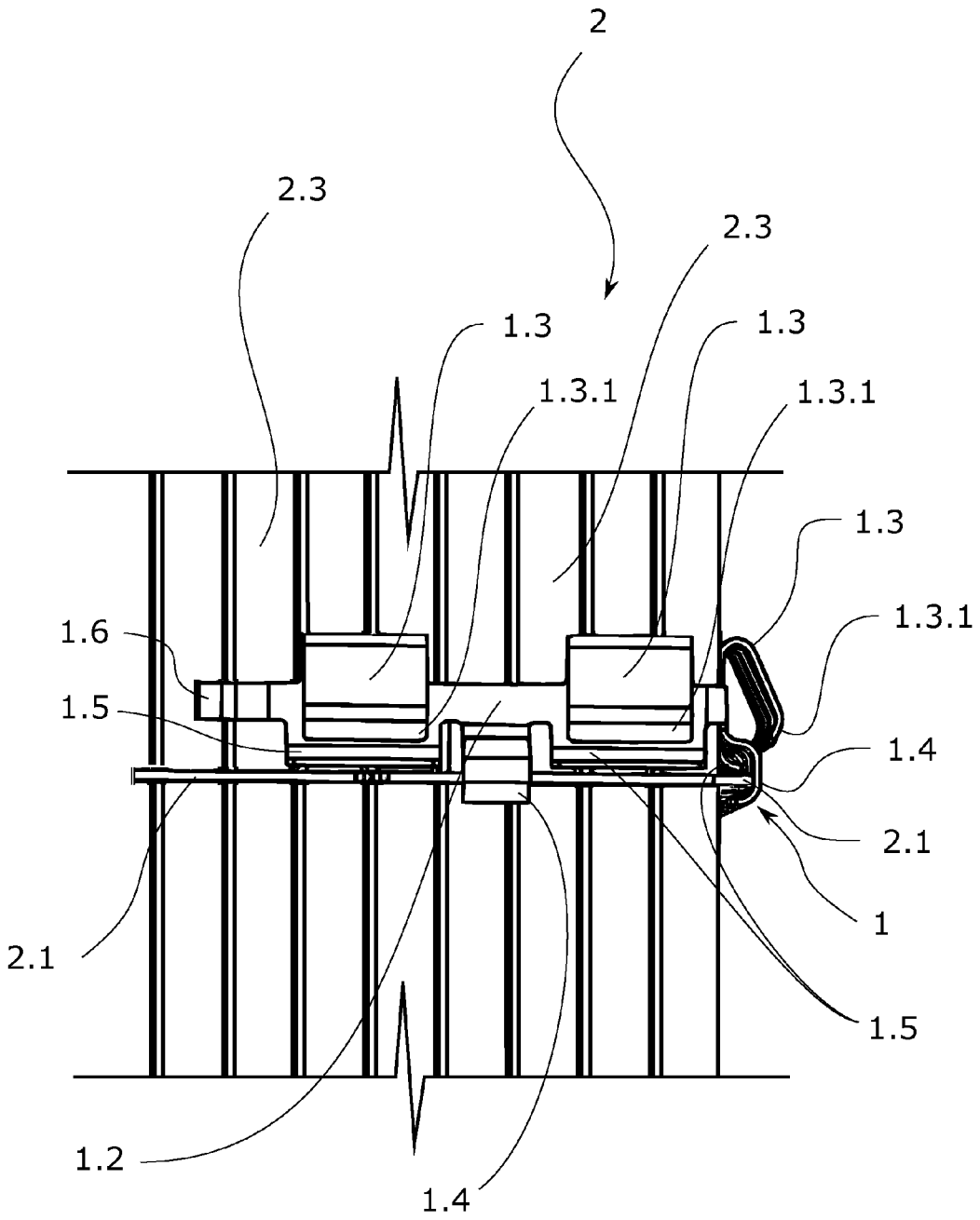
FIG. 4 shows a side detail of the attachment between the device according to the same embodiment and the bundle or battery.

FIG. 4 shows a portion of the tube bundle (2) with a side view of the device (1). Following the orientation shown in the figure, the longitudinal direction of the tubes is vertical and the insertion of the device (1) is from right to left. In this figure it is possible to observe how the anchors (1.4) of the right, which correspond to the first section (1.1), will approach one another until covering the protrusion formed by the linking part (2.1).

Following this same direction of insertion of the device (1) of the invention, the anchor (1.4) seen in the middle of the figure and which corresponds to the second section (1.2) will enter from the right, housing from the beginning the protrusion formed by the linking part (2.1), and will slide to its final position, allowing the passage of the protrusion of the linking part (2.1).

On the side opposite to where the flexible elements (1.3) extend, there extend skids (1.5) with a bend perpendicular to the support surface of the bundle (2) which reduces the transverse clearance of the protrusion formed by the linking part (2.1) inside the anchor (1.4).

The clip (1.6) is configured to coincide with a gap formed between tubes of the bundle (2). The bundle (2) used in this FIG. 4 has a plurality of recesses in the side surface (2.3) whereas the bundle (2) used in FIG. 1 only has one recess so that the figure is not too complicated.

The anchors (1.4) prevent the longitudinal movement but allow the insertion without needing to drill the linking part (2.1) or insert tabs which recover inside a hole as occurs in the state of the art.

The attachment by means of the clamping in opposition which occurs due to the U-shaped configuration and with the retention of the clip (1.6) prevents the existence of clearances which would be the source of additional vibrations and noise.

The invention claimed is:

1. A device for reducing vibrations of a tube core inside a shell of a heat exchanger, wherein said tube core includes a main face and two side faces adjacent to the main face, and at least one linking part between tubes of the tube core giving rise to a protrusion in the main face and the two side faces, and wherein the device comprises:

a first section adapted to be arranged on the main face and two second sections adapted to be arranged on the two side faces, wherein each second section extends from a different end of the first section and the two second sections are arranged in opposition to one another, such that the first section and the second sections in combination form a "U" shape;

at least one anchor arranged in each section and oriented toward the inside of the "U" shape formed by the first section and the second sections in combination, wherein each anchor is adapted to receive a protrusion formed by the at least one linking part between tubes of the tube core; and at least one elastically deformable support element arranged in each section and oriented toward the outside of the "U" shape formed by the first section and the second sections in combination, wherein the at least one elastically deformable support element is adapted to be supported against at least one inside surface of the shell of the heat exchanger;

wherein each second section of the two second sections comprises a retaining clip, and the retaining clips of the two second sections operate in opposition to one another to retain the device on the tube core.

2. The device according to claim 1, wherein the first section and the two second sections comprise a die-cut and bent flat bar.

3. The device according to claim 1, wherein the at least one elastically deformable support element arranged in each section comprises a wedged bend that allows the tube core to be inserted into the shell of the heat exchanger.

4. The device according to claim 3, wherein the at least one elastically deformable support element arranged in each section comprises a second bend, giving rise to an oblique extension facilitating the extraction of the tube core without being locked in the shell of the heat exchanger.

5. The device according to claim 2, wherein the at least one anchor arranged in the first section or the second section is configured as a transverse extension of the respective first or second section with bends that give rise to an additional "U" shape oriented towards the inside of the "U" shape formed by the first section and the two second sections in combination, and is adapted to embrace the protrusion formed by the at least one linking part between tubes of the tube core.

6. The device according to claim 5, wherein each section comprises at least one skid extending from the section and including a bend perpendicular to an adjacent external surface of the tube core to reduce transverse clearance of the protrusion formed by the at least one linking part received by the at least one anchor.

7. The device according to claim 2, wherein each retaining clip comprises at least one bend forming an apex pointing toward an inside of the "U" shape formed by the first section and the second sections in combination.

8. The device according to claim 7, wherein the retaining clips are arranged at ends of the second sections.

9. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 1 establishing a support between the tube core and the shell.

10. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 2 establishing a support between the tube core and the shell.

11. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 3 establishing a support between the tube core and the shell.

12. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 4 establishing a support between the tube core and the shell.

13. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 5 establishing a support between the tube core and the shell.

14. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 6 establishing a support between the tube core and the shell.

15. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 7 establishing a support between the tube core and the shell.

16. A heat exchanger comprising a shell housing therein a tube core for the passage of fluid to be cooled, wherein the core comprises a main face and two side faces adjacent to the main face, wherein the tube core includes at least one linking part between tubes of the tube core giving rise to a protrusion in the main face and the adjacent side faces, and wherein the at least one linking part between tubes of the tube core comprises a device for reducing vibrations according to claim 8 establishing a support between the tube core and the shell.

* * * * *